US005320460A

United States Patent [19]

Murakami et al.

[11] Patent Number: 5,320,460

[45] Date of Patent: Jun. 14, 1994

[54] SEALING ASSEMBLY FOR FILLER HOLE

[75] Inventors: Yuichi Murakami, Fujisawa; Yoshihiro Iwata, Nagoya, both of Japan

[73] Assignees: Minebea Kabushiki-Kaisha, Nagano; Mitsubishi Jukogyo Kabushiki-Kaisha, Tokyo, both of Japan

[21] Appl. No.: 82,766

[22] Filed: Jun. 28, 1993

[30] Foreign Application Priority Data

Jun. 30, 1992 [JP] Japan ..... 4-196362

[51] Int. Cl.[5] ..... F16B 13/06; F16L 55/10

[52] U.S. Cl. ..... 411/55; 411/60; 411/542; 138/89

[58] Field of Search ..... 411/15, 55, 60, 61, 411/369, 542; 138/89, 90

[56] References Cited

U.S. PATENT DOCUMENTS

| | | | |
|---|---|---|---|
| 2,132,636 | 10/1938 | Maahs | 411/55 X |
| 2,751,809 | 6/1956 | Barker | 411/15 |
| 2,884,099 | 4/1959 | Nenzell | 411/369 X |
| 3,087,370 | 4/1963 | Iaia | 411/369 |
| 4,391,559 | 7/1983 | Mizusawa | 411/60 X |

FOREIGN PATENT DOCUMENTS

| | | | |
|---|---|---|---|
| 618033 | 2/1949 | United Kingdom | 411/60 |
| 1013219 | 12/1965 | United Kingdom | 411/60 |
| 1166262 | 10/1969 | United Kingdom | 411/60 |

*Primary Examiner*—Neill R. Wilson
*Attorney, Agent, or Firm*—Fred Philpitt

[57] ABSTRACT

A plug-type sealing assembly for hermetically closing a filler hole 24 of a lid 19 of a container 20, comprises: a plug 1 having a rod portion 3 in an upper part of which a large-diameter head portion 2 is formed, the rod portion 3 having a male screw 5 in its outer peripheral surface; and, a sleeve 8 provided with an axial through-hole together with a countersunk head portion 10 and a slit skirt portion 11 extending downward from a lower end of said countersunk head portion 10. In the through-hole, a female screw 15*a*, 15*b* is formed. In the container 20: through the filler hole 24 a sealant 23 is supplied between joint portions of the container 20 so that the container 20 is hermetically sealed; and, the sealing assembly is easily removed from the filler hole 24 to ensure that the sealant 23 is supplemented or replaced with a new one through the filler hole 24 in an easy and a safety manner, and easily mounted again in the filler hole 24 after completion of such supplementing or replacing operation of the sealant 23, by threadably engaging the male screw 5 of the plug 1 with and disengaging from the female screw 15*a*, 15*b* of the sleeve 8.

4 Claims, 3 Drawing Sheets

SEALING ASSEMBLY FOR FILLER HOLE

BACKGROUND OF THE INVENTION

1. Field of the Invention

The present invention relates to a plug-type sealing assembly for hermetically closing a filler hole of a lid of a container, through which hole a sealant is supplied between joint portions of the container.

2. Description of the Prior Art

Heretofore, it has been known to provide a container constructed of two members which are provided with joint portions connected with each other through a gelled or jelly-like sealant.

In such conventional container, the sealant becomes smaller in volume or worse in quality with the lapse of time to lose its proper sealing function. When the sealant loses its proper sealing function, it is necessary to remove one of the members of the container in order to have the sealant supplemented or replaced with a new one. However, such removing and attaching operation of the member is very cumbersome, and, therefore takes too much time.

Further, in case that contents of the container are gases or volatile liquids, these contents are partially lost and spread around the container when the member is removed from the container in order to supplement or replace the sealant with a new one. If the gases or volatile liquids are flammable, there is a fear that a fire breaks out around the container.

SUMMARY OF THE INVENTION

It is an object of the present invention to provide a plug-type sealing assembly for hermetically closing a filler hole formed in one of two members forming a container in which: through the filler hole a sealant is supplied between joint portions of the two members or container so that the container is hermetically sealed; and, the sealing assembly of the present invention is easily removed from the filler hole of the member of the container to ensure that the sealant is supplemented or replaced with a new one through the filler hole of the member in an easy and a safety manner, and easily mounted again in the filler hole of the member after completion of such supplementing or replacing operation of the sealant.

The above object of the present invention is accomplished by providing:

A sealing assembly for a filler hole, comprising:

a plug provided with a rod portion in an upper part of which a large-diameter head portion is formed, the rod portion being provided with a male screw in its outer peripheral surface; and a sleeve provided with a countersunk head portion and a skirt portion extending downward from a lower end of the countersunk head portion;

the countersunk head portion having its outer peripheral surface tapered so as to have its upper end be larger in diameter than the lower end, the countersunk head portion being provided with a counter bore in its upper portion, the counter bore being slightly larger in diameter than the large-diameter head portion of the plug and having its lower end be integral with an upper end of a tapered bore which has its peripheral surface tapered so as to have its upper end be large in diameter than the lower end thereof;

the skirt portion assuming a cylindrical shape which has its wall portion tapered so as to have an upper end of the wall portion tapered so as to have an upper end of the wall portion be smaller in thickness than a lower end thereof, said skirt portion being provided with a plurality of axial slits in the wall portion at appropriate angular intervals to permit the slits to have a lower end of the wall portion divided into a plurality of free ends;

the counter bore of the sleeve having its lower end be integral with a straight axial bore of the countersunk head portion which is integral with the skirt portion, the straight axial bore being integral with an axial bore of the skirt portion provided with the slits so as to form an integral axial bore forming a female screw which is threadably engaged with the male screw of the plug;

whereby the skirt portion of the sleeve is forcibly enlarged in diameter radially outward when the plug is threadably engaged with the sleeve.

Further, the above object of the present invention is accomplished by providing the sealing assembly having the above construction in which: the outer peripheral surface of the countersunk head portion of the sleeve further has its lower area formed into an annular groove in which an O-ring is mounted; and, the countersunk head portion of the sleeve is further provided with at least one concave portion (which receives therein a suitable detent means for preventing the sleeve from rotating when the plug is threadably engaged with the sleeve) in its upper portion.

In use, the sealing assembly of the present invention is fixedly mounted in the filler hole formed in one of the two members which have their joint portions connected with each other through the sealant.

Namely, in use, the sleeve of the sealing assembly is inserted into the filler hole in a condition in which the skirt portion of the sleeve is reduced in diameter. After completion of insertion of the sleeve into the filler hole, the plug is threadably engaged with the sleeve using a socket-screw hexagonal wrench (i.e., Allen wrench).

When the male screw portion of the plug is threadably engaged with the female screw portion of the sleeve, the diameter of the skirt portion of the sleeve is forcibly enlarged radially outward by the plug so that an outer peripheral surface of the skirt portion of the sleeve is press-fitted to an inner wall surface of the filler hole of the member of the container, whereby the sealing assembly of the present invention is fixedly mounted in the filler hole of the member in a condition in which a lower chamfered part of the head portion of the plug is press-fitted to the tapered surface of the countersunk head portion of the sleeve so that an O-ring is compressed between the outer peripheral surface of the head portion of the sleeve and the the inner wall surface of the filler hole of the member of the container.

As a result, a space between the filler hole of the member of the container and the sleeve is hermetically sealed with the O-ring, and a space between the plug and the sleeve is hermetically sealed by press-fitting the chamfered part of the head portion of the plug to the tapered bore of the sleeve.

DESCRIPTION OF THE PREFERRED EMBODIMENTS

Now, the present invention will be described in detail with reference to the drawings.

Figure 7:
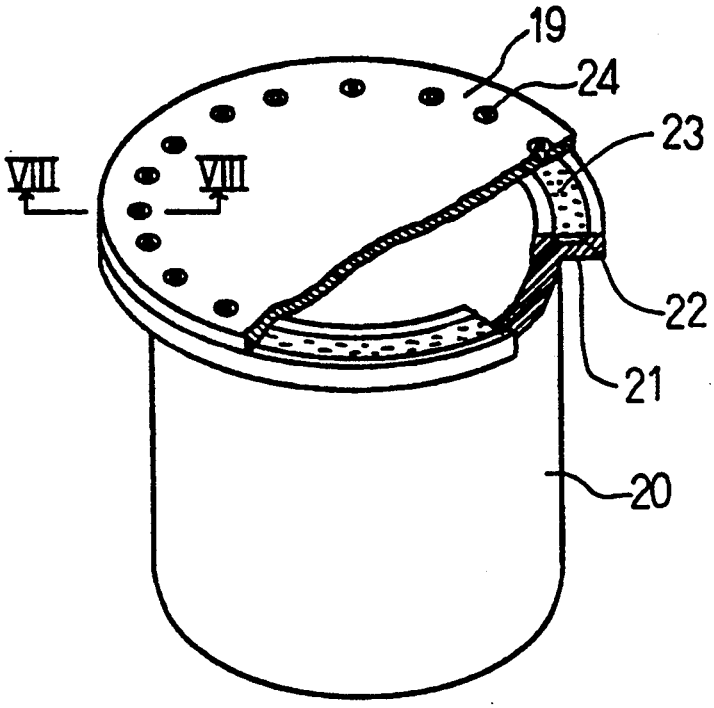
FIG. 7 is a partially broken perspective view of the container in which the sealing assembly of the present invention is used.
Figure 8:
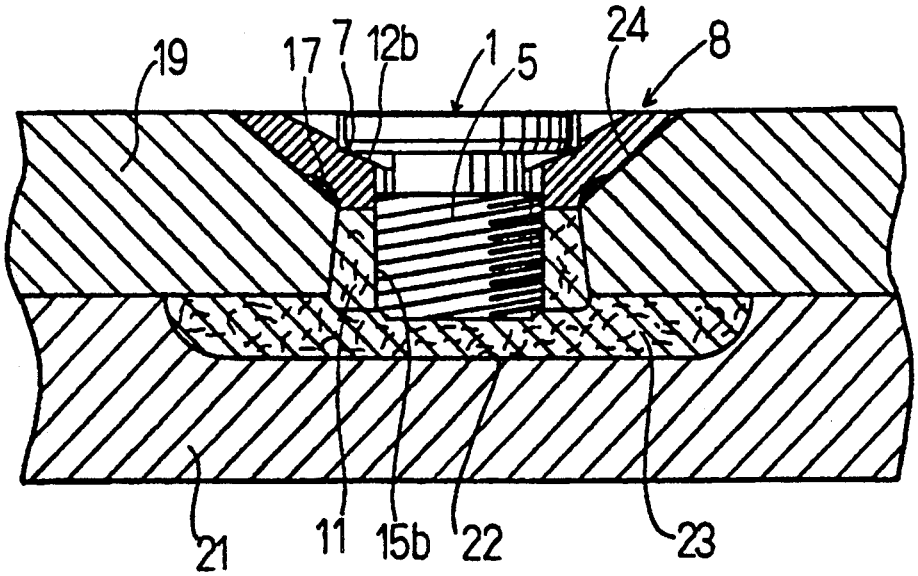
FIG. 8 is an enlarged longitudinal sectional view of an essential part of the container, taken along the line VIII—VIII of FIG. 7.

FIGS. 1 to 6 show an embodiment of a plug-type sealing assembly of the present invention. FIGS. 7 and 8 show a container in which the sealing assembly is used.

The sealing assembly of the present invention, which is used to hermetically close a filler hole 24 of a lid 19 of a container 20 shown in FIG. 7, comprises a plug 1 and a sleeve 8 with which the plug 1 is threadably engaged.

Figure 1:
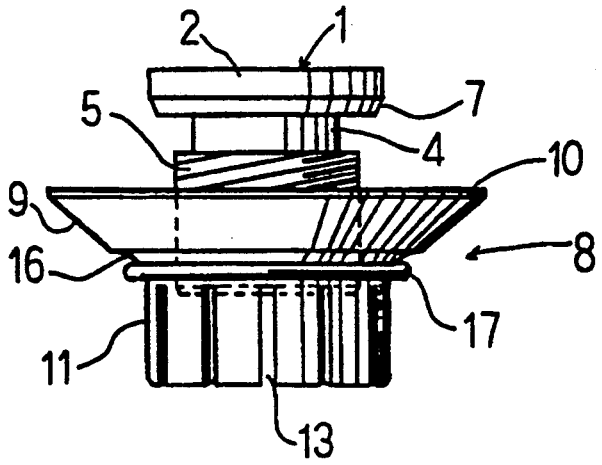
FIG. 1 is a side view of an embodiment of the sealing assembly of the present invention for hermetically closing the filler hole.
Figure 2:
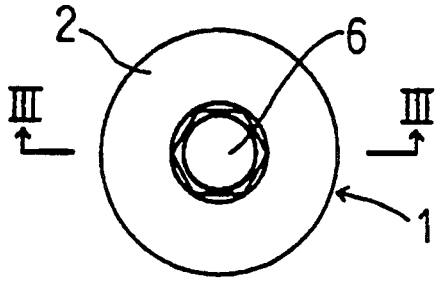
FIG. 2 is a plan view of the plug of the sealing assembly of the present invention shown in FIG. 1.
Figure 3:
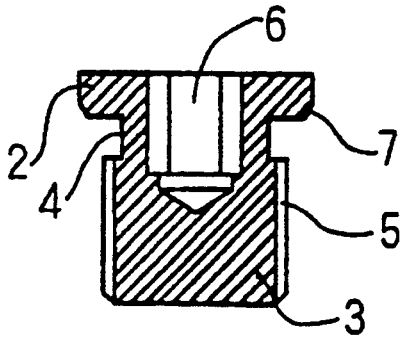
FIG. 3 is a longitudinal sectional view of the plug, taken along the line III—III of FIG. 2.
Figure 4:
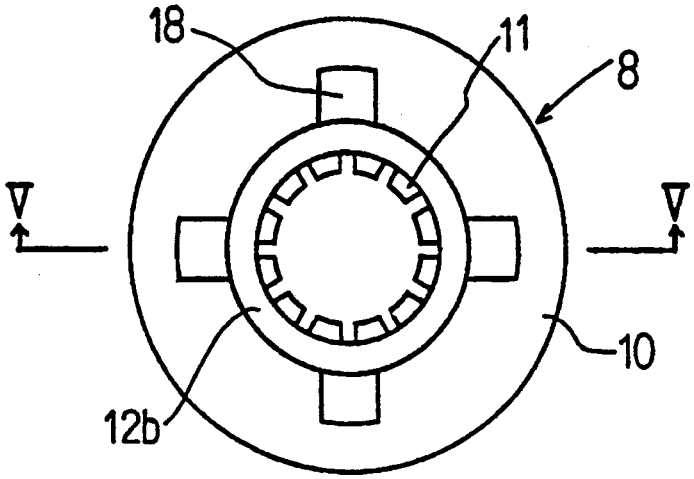
FIG. 4 is a plan view of the sleeve of the sealing assembly of the present invention shown in FIG. 1.

As shown in FIGS. 2 and 3, the plug 1 is provided with a rod portion 3 in an upper part of which a large-diameter head portion 2 is formed. The rod portion 3 is provided with a non-threaded part 4 which is immediately adjacent to a lower surface of the head portion 2. A male screw 5 is formed in an outer peripheral surface of the rod portion 3 adjacent to the the non-threaded part 4. In the head portion 2 of the plug 1, there is formed a hexagonal counter bore 6 for receiving a socket-screw hexagonal wrench (i.e., Allen wrench).

The sleeve 8 is provided with a countersunk head portion 10 and a skirt portion 11 extending downward from a lower end of the countersunk head portion 10. The countersunk head portion 10 has its outer peripheral surface tapered to form a tapered surface 9 which has its upper end be larger in diameter than the lower end.

Further, the countersunk head portion 10 of the sleeve 8 is provided with a counter bore **12*a* in its upper portion. The counter bore 12*a* is slightly larger in diameter than the head portion 2 of the plug 1 and has its lower end be integral with an upper end of a tapered bore 12*b*** which has its peripheral surface tapered so as to have its upper end be large in diameter than the lower end thereof.

The skirt portion 11 of the sleeve 8 assumes a cylindrical shape which has its wall portion tapered so as to have an upper end of the wall portion be smaller in thickness than a lower end thereof. Further, the skirt portion 11 is provided with a plurality of axial slits 13 in the wall portion at appropriate angular intervals to permit the slits 13 to have the lower end of the wall portion divided into a plurality of free ends the number of which is, for example, 12 in case of the embodiment shown in FIGS. 4 and 6. As shown in dotted lines of FIG. 5, under normal conditions, the skirt portion 11 of the sleeve 8 has a constant inner diameter so that its outer peripheral surface forms a tapered surface having its upper end be smaller in diameter than a lower end thereof.

The counter bore **12*a* of the sleeve 8 has its lower end be integral with a straight axial bore 14 of the countersunk head portion 10 which is integral with the skirt portion 11. The straight axial bore 14 is integral with an axial bore 15*b* of the skirt portion 11 provided with the slits 13 so as to form an integral axial bore 15*a*, 15*b* forming a female screw portion 15*a*, 15*b* which is threadably engaged with the male screw 5 of the plug 1** in use.

Figure 5:
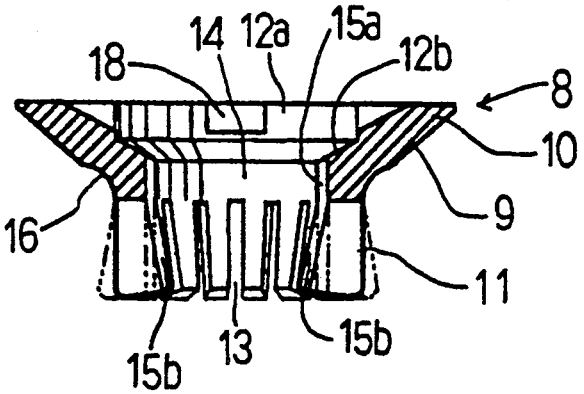
FIG. 5 is a longitudinal sectional view of the sleeve, taken along the line V—V of FIG. 4.

In use, when the sleeve 8 is inserted into the filler hole 24 of the lid 19 of the container 20 (shown in FIG. 7), the skirt portion 11 of the sleeve 8 is radially inwardly compressed to have its outer diameter be constant as shown in solid lines of FIG. 5. In this condition, the female screw portion **15*b* is tapered to have its lower end be smaller in diameter than an upper end thereof. Consequently, under such circumstances, i.e., after completion of insertion of the sleeve 8 into the filler hole 24, when the plug 1 is forcibly engaged with the sleeve 8 by threadably engaging the male screw portion 5 of the plug 1 with the female screw portion 15*b* of the sleeve 8, the skirt portion 11 is of the sleeve 8** is radially outwardly enlarged as shown in dotted lined in FIG. 5.

Figure 6:
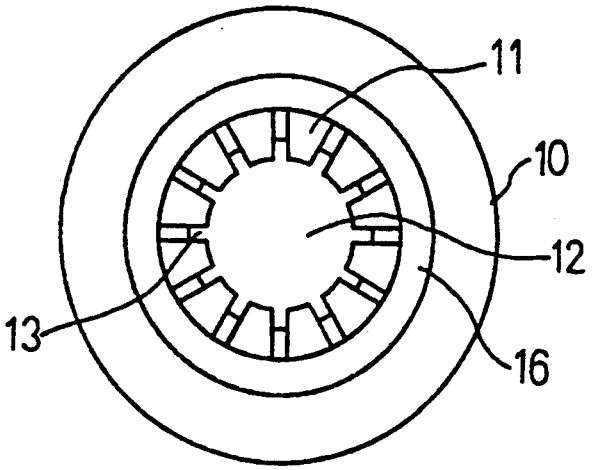
FIG. 6 is a bottom view of the sleeve shown in FIG. 4.

As shown in FIG. 6, in an appropriate portion of the outer peripheral surface of the countersunk head portion 10 of the sleeve 8, there is formed a lower annular groove 16 for receiving an O-ring 16 therein.

Incidentally, a plurality of concave portions 18 for receiving a suitable detent means (not shown) are formed in the upper surface of the countersunk head portion 10 of the sleeve 8. The detent means is used to prevent the sleeve 8 from rotating when the plug 1 is threadably engaged with the sleeve 8.

The embodiment of the sealing assembly of the present invention is used to hermetically seal the filler hole 24 through which a gelled or jelly-like sealant 23 is supplied.

For example, in case of containers for holding volatile liquids therein, the containers must be hermetically sealed so as to prevent gases or vapor of the liquids from leaking therefrom.

As an example of such containers, the container 20 is shown in FIG. 7. The container 20 is provided with an upper flange 20 around its opening which is closed with the lid 19. An annular groove 22 is formed in an upper surface of the flange 21. The groove 22 is filled up with the gelled or jelly-like sealant 23 before the opening of the container 20 is closed with the lid 19 using screws and like fasteners (not shown).

The sealing assembly of the present invention is used in the filler hole 24 formed in the lid 19 of such container 20. As is clear from FIG. FIG. 8, the filler hole 24 is provided with at least a tapered surface which is the same in configuration as that of the skirt portion 11 of the sleeve 8 having been radially outwardly enlarged in diameter.

In mounting operation of the sleeve 8 in the filler hole 24, the sleeve 8 is inserted into the filler hole 24 in a condition in which the skirt portion 11 has been already reduced in diameter. After completion of such insertion of the sleeve 8 into the filler hole 24, the plug 1 is threadably engaged with the sleeve 8 by using the socket-screw hexagonal wrench (i.e., Allen wrench) and the above-mentioned detent means (not shown).

As the male screw portion 5 of the plug 1 is threadably engaged with the female screw portion **15*b* of the sleeve 8, the outer diameter of the skirt portion 11 gradually increases so that the outer peripheral surface of the skirt portion 11 is eventually press-fitted to the inner wall surface of the filler hole 24. At the same time, the plug 1 has its lower chambered part 7** of the head portion 2 press-fitted to the the tapered surface 12*b* of the countersunk head portion 10 of the sleeve 8, and the O-ring 17 is compressed between the outer peripheral surface of the countersunk head portion 10 of the sleeve 8 and the inner wall surface of the filler hole 24.

By compressing the O-ring 17 as described in the above, a space between the filler hole 24 and the sleeve 8 is hermetically sealed. Further, a space between the plug 1 and the sleeve 8 is also hermetically sealed by press-fitting the lower chamfered part 7 of the head portion 2 of the plug 1 to the tapered bore 12*b* of the sleeve 8.

When the sealant 23 is deteriorated in its sealing function with the lapse of time, the sealant 23 is supplemented or replaced with a new one through the filler hole 24 of the lid 19 after the plug 1 is removed from the sleeve 3 or after the entire sealing assembly (1, 8, 17) is removed from the filler hole 24. After completion of supplementing or replacing operation of the sealant 23, the plug 1 is threadably engaged with the sleeve 8 to hermetically seal the filler hole 8.

Since the sealing assembly of the present invention has the above construction, the sealing assembly of the present invention can is easily removed from the filler hole 24 of the lid 19 of the container 20 to ensure that the sealant 23 is supplemented or replaced with a new one through the filler hole 24 in an easy and a safety manner, and easily mounted again in the filler hole 24 after completion of such supplementing or replacing operation of the sealant 23.

What is claimed is:

1. A sealing assembly for a filler hole comprising:

(a) a plug (1) comprising a lower rod portion (3) and an upper part which includes a large-diameter head portion (2), the rod portion (3) being provided with a male screw on its outer peripheral surface; and (b) a sleeve (8) comprising a countersunk head portion (10) and a skirt portion (11) extending downward from the lower end of said countersunk head portion (10);

said countersunk head portion (10) having its outer peripheral surface (9) tapered so that its upper end is larger in diameter than its lower end, said countersunk head portion (10) also being provided with a counter bore (12*a*) in its upper portion, the upper end of said counter bore (12*a*) being slightly larger in diameter than the large-diameter head portion (2) of said plug (1) and having its lower end integral with the upper end of a tapered bore (12*b*) which has its peripheral surface tapered so that its upper end is larger in diameter than the lower end of the tapered bore (12*b*);

said skirt portion (11) having a wall portion tapered so that the upper end of said wall potion is smaller in thickness than the lower end of the wall portion, said skirt portion (11) having a plurality of axial slits (13) in said wall portion at angular intervals so that the lower end of said wall potion is divided into a plurality of free ends;

said counter bore (12*a*) of said sleeve (8) having its lower end integral with a straight axial bore (14) in said countersunk head portion (10) which is integral with said skirt portion (11), said straight axial bore (14) being integral with the axial bore (15*b*) of said skirt portion (11) provided with said slits (13) so as to form an integral axial bore forming a female screw which is threadably engageable with said male screw (5) of said plug (1);

whereby said skirt portion (11) of said sleeve (8) is forcibly enlarged in diameter radially outwardly when said plug (1) is threadably engaged with said sleeve (8).

2. A sealing assembly according to claim 1 wherein said countersunk head portion (10) is also provided with a concave portion (18) which is adapted to receive a detent means to prevent said sleeve (8) from rotating in its upper portion.

3. A sealing assembly according to claim 2 wherein said tapered outer peripheral surface has its lower area formed into an annular groove (16) into which an O-ring (17) is mounted.

4. A sealing assembly according to claim 3 wherein said tapered outer peripheral surface (9) has its lower area formed into an annular groove (16) into which an O-ring (17) is mounted.

* * * * *